United States Patent [19]

Graiff et al.

[11] 4,300,494

[45] Nov. 17, 1981

[54] THERMAL INSULATED INTAKE PORTS

[75] Inventors: Leonard B. Graiff; Earl J. Haury, both of Houston, Tex.

[73] Assignee: Shell Oil Company, Houston, Tex.

[21] Appl. No.: 78,866

[22] Filed: Sep. 26, 1979

[51] Int. Cl.[3] ..... F02F 1/42

[52] U.S. Cl. ..... 123/193 H; 123/668

[58] Field of Search ..... 123/193 R, 193 H, 668, 123/669, 657

[56] References Cited

U.S. PATENT DOCUMENTS 2,978,360 4/1961 Bradstreet et al. ..... 123/669

3,066,663 12/1962 Rudy ..... 123/668

4,207,660 6/1980 Rao et al. ..... 123/193 H

FOREIGN PATENT DOCUMENTS 2602434 7/1977 Fed. Rep. of Germany ... 123/193 H 2729230 1/1979 Fed. Rep. of Germany ..... 123/668

*Primary Examiner*—Craig R. Feinberg

*Attorney, Agent, or Firm*—Ronald R. Reper

[57] ABSTRACT

Reduced fuel consumption of spark ignition reciprocating internal combustion engines is achieved by coating the intake port area of the engine with a thermally insulating material.

8 Claims, 1 Drawing Figure

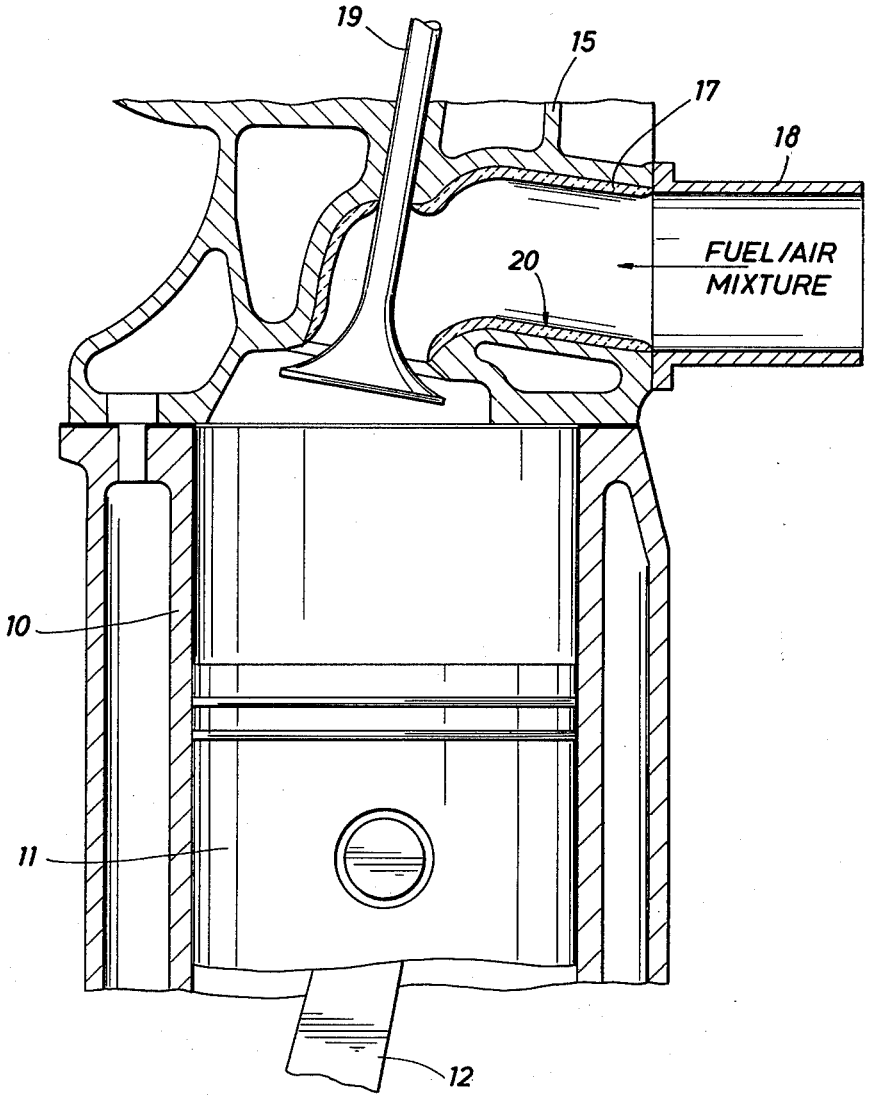
19
15
17
18
FUEL/AIR
MIXTURE
20
10
11
12

THERMAL INSULATED INTAKE PORTS

BACKGROUND OF THE INVENTION

This invention relates to improvements in spark-ignition reciprocating internal combustion engines, and more particularly to improvements in the fuel inlet port area whereby reduced fuel consumption is achieved.

Research efforts concerning internal combustion engines have concentrated on problems as they have developed. For example, for the problem of "rumble" in high compression engines one solution is thermally insulated combustion chambers as described in U.S. Pat. Nos. 3,019,277 and 3,066,663 to T. P. Rudy. The use of gasoline detergents to control the adverse effect of intake system deposits from the fuel is described by G. H. Amberg and W. S. Craig in SAE Paper 554D presented at Los Angeles, Calif. In August, 1962. As part of this study the authors used synthetic deposits prepared from a two part epoxide-curing agent adhesive to study the desired range of deposits. In those rotary piston engines having both inlet and outlet passages and the bearing for the inner rotary piston located in a single member, the use of protective lacquer in said passages to reduce heat flow to the bearing is described in U.S. Pat. No. 3,115,871 to Lück.

Today, the rapid depletion of petroleum supplies in the world coupled with rapid escalation of costs for gasoline fuel for spark ignition reciprocating engines, mandates the implementation of all improvements to conserve precious fuel supplies. The present invention provides a relatively simple, unexpectedly efficient improvement in such engines to improve their fuel efficiency, particularly at low speeds. Further, there is some evidence that certain coatings according to the invention may reduce ultimate octane requirement increase typically experienced after mileage accumulations.

SUMMARY OF THE INVENTION

The invention provides a spark ignition reciprocating internal combustion engine for use with gasoline fuel said engine having an intake port area extending between an intake manifold and an intake valve, said intake valve disrupting flow of a fuel-air mixture into a combustion chamber of said engine; and having a substantial portion of the surface of said intake port area coated with a thermal insulating material for reducing transfer of heat to the fuel-air mixture which traverses said intake port area during operation of the engine; said thermal insulating material including inorganic and resinous materials having in their chemical structure an element selected from fluorine, silicon, and/or sulfur.

The invention further provides a method for reducing the fuel consumption of a gasoline fueled spark ignition reciprocating engine having an intake port area extending between an intake manifold and an intake valve, which comprises coating a substantial portion of the surface of said intake port area with a thermally insulating material selected from inorganic materials and synthetic resinous materials having in their structure an element selected from fluorine, silicon and sulfur.

BRIEF DESCRIPTION OF THE DRAWING

The FIGURE is a partial horizontal sectional view through an engine cylinder embodying the present invention showing a thermal insulating coating on the surface of the inlet port area.

DESCRIPTION OF PREFERRED EMBODIMENTS

It is known that with modern gasolines containing detergent additives that it is possible to prevent, or substantially reduce the formation of carbonaceous deposits in the fuel inlet systems of spark ignition gasoline engines. Applicants have unexpectedly discovered that by applying a controlled thermal insulation as herein defined to the inlet port area that reduced fuel consumption can be achieved.

An engine constructed in accordance with this invention is shown in the drawing and includes a cylinder 10 with a piston 11 and connecting rod 12 which runs to a crankshaft, not shown. The top of the cylinder mounts a cylinder head 15 which is provided with an intake port 12 extending between intake manifold 18 and intake valve 19. The surface of the intake port is coated with a thermal insulating material 20, for reducing transfer of heat from the engine to the fuel/air mixture which traverses the intake port during operation of the engine.

The insulating coatings of this invention have a thermal conductance from about 30 B.T.U./hr./sq ft/°F. to about 5000 B.T.U./hr./sq. ft/°F. For example, a 30 mil coating of polyphenylene sulfide having a thermal conductivity of 2 B.T.U./hr/sq. ft/°F./in. has a thermal conductance of about 67 B.T.U./hr/sq. ft/°F. In a preferred embodiment of the invention the insulating coating has a thermal conductance from about 50 to about 1000 B.T.U./hr/sq. ft/°F.

Any conventional method of applying the thermal insulation to the inlet port area can be employed. The insulating material of the invention is an inert coating of low thermal conductivity having high resistance to thermal shock and which may be an inorganic ceramic type of material or a synthetic resinous polymeric material having in its structure fluorine, silicon or sulfur. These coating materials ordinarily will be employed in thicknesses from about 0.5 to about 75 mils and preferably from about 2 to 70 mils with optimum thickness within this range being determined by engine design and the thermal conductivity of the particular coating material employed. The coating materials employed in this invention will have adhesive and cohesive properties adequate to avoid fracturing or peeling during operations of the engine.

Preferably the coating material will also have high melting point, e.g., above about 450° F., and more preferably above 475° F.; good mechanical strength, low coefficient of thermal expansion and low thermal conductivity.

A wide variety of refractory type oxide coatings can be employed. For example, the oxides of zirconium, chromium, titanium, cerium and manganese and certain phosphates, silicates, fluoro silicates and oxyhalides of these materials may be used. Exemplary synthetic resinous materials include silicone homopolymers and copolymers, polysiloxane-resin; sulfur containing polymers such as polyphenylene sulfide, and fluoro polymers such as polytetra fluoroethylene and fluorinated ethylene propylene copolymer; and mixtures of these materials.

The coatings may be applied by any conventional techniques such as, for example, flame spraying wherein the coating material is melted in a flame gun and sprayed on the surface to be coated; powder coating, for example, with an electrostatic powder gun which is particularly suitable for port areas of intricate geometry, and simple powder coating followed by baking; in some instances manual application of curable resins may be used.

It is preferred to employ coatings which contain surface roughness to enhance turbulence of the fuel-air mixture traversing the inlet port area to enter the combustion chamber. However, the coating should not impede flow during high speed operations.

The coating according to the invention will substantially cover all surfaces within the inlet port area, but not be applied to the valve seat, or to surfaces within the combustion chamber of the engine. It is preferred that at least 65% and more preferably at least 75% of the inlet port area surface be coated.

The present invention is operative in all spark ignition reciprocating internal combustion engines employing gasoline as the major fuel component, including 4 cycle and 2 cycle engines. Furthermore, the concept of the present invention is equally effective in air cooled and water-cooled systems. The internal combustion engines having the inlet port area coated according to the invention are made of metals conventionally used in internal combustion engines, i.e., cast iron, aluminum, steel and the like.

It should be understood that an engine according to the present invention will ordinarily be operated on a gasoline fuel, i.e., a petroleum fraction boiling in the gasoline range (between about 50° F. and about 450° F.). The gasoline may be free of, or may contain small amounts, e.g., 0.01–3.17 grams per gallon of organometallic anti-knock compounds such as tetraethyl lead, tetramethyl lead, methyl cyclopentandienyl manganese tricarbonyl, tris(acetyl-acetonate)ironIII, nickel 2-hexylsalicylate and/or vanadium acetyl acetonate and mixtures of these. The invention can be used with commercial gasoline products of conventional refinery processes such as distillation, thermal cracking, catalytic cracking, alkylation, catalytic reforming, catalytic isomerization and the like. The gasoline fuel may also contain conventionally employed additives such as corrosion inhibitors, antioxidants, detergents and up to about 10% by volume of organic materials such as methyltertiarybutylether, tertiarybutylacetate, methylalcohol, ethylalcohol and the like.

The following are illustrative examples of the invention showing the use of specific coating compositions according to the invention.

EXAMPLE I

A 1977 model 301 cubic inch (4.9 l) displacement engine installed on a dynamometer stand equipped with a flywheel to simulate the inertia of a car was used. The engine had a two barrel carburetor and automatic transmission; standard equipment included exhaust gas recirculation (EGR) and a breakerless electronic ignition system. Specifications of the engine included a compression ratio of 8.2, a maximum brake horsepower of 135 at 4000 rpm and maximum torque of 245 ft-lbs. at 2000 rpm. After the engine had been operated for about 2490 hours equivalent to about 90,000 miles of driving operation, the cylinder heads were unbolted and all accumulated deposits removed from surfaces of the intake ports, intake valves, piston tops and cylinder heads. This work is part of a study detailed in SAE Paper 790938 by L. B. Graiff. Gally proofs of said paper accompany this application and are incorporated herein by reference. Fuel consumption was measured at 25, 45 and 65 mph (40, 72 and 105 km/h) equivalent level-road-load speeds by a mini-computer, while recording the loss in weight from an electronic balance of a can of fuel supplying the engine. Readings were recorded every minute for ten minutes by a computer which also calculated the mean and standard deviation. During the fuel consumption tests, the operating temperatures were maintained as follows: jacket water out, 95° C. (203° F.); oil gallery, 95° C. (203° F.) and carburetor air, 45° C. (113° F.) with a constant humidity (82 grains of water per pound of dry air, or about 20% relative humidity at 45° C). The engine lubricant was a multigrade 10W40 of API SE Quality. After fuel consumption data on the "clean" (i.e., deposit removed) engine were determined, the head bolts were again removed and substantially all of the intake port surface areas in the engine heads were coated with a 15 mil-thick layer of resinous coating of polyphenylene sulfide resin and a second 15 mil layer of a blend of polyphenylene sulfide and polytetrafluoroethylene resin. The engine was reassembled and the fuel consumption of the engine was again determined.

TABLE I

EFFECT OF AN INTAKE PORT COATING OF POLYPHENYLENE SULFIDE/TFE ON FUEL CONSUMPTION (1977 Pontiac 301 CID-2V Engine)

| | Fuel Consumption, g/min | | |
|---|---|---|---|
| | 65 mph | 45 mph | 25 mph |
| Before Coating [a] | 182.9 | 105.6 | 52.8 |
| After Coating[a] | 177.1 | 103.7 | 52.0 |
| % Reduction | 3.2 | 1.8 | 1.5 |

[a]With clean engine, i.e., with no combustion chamber deposits or port deposits.

The results as shown in Table I exemplify the beneficial effect on fuel economy, i.e., lowered fuel consumption according to the invention. Unexpectedly, it was observed that after 375 hours of operation with detergent-free gasoline the engine having the coated intake ports according to the invention, had a lower octane requirement (of about 2 octane numbers) than the same engine without the coating for a like period with the same fuel. Visual inspection of the intake port area after the 375 hours of operation revealed much smaller accumulation of hydrocarbonaceous deposits than typically found for this period of operation.

EXAMPLE II

A 1977 Ford 351 (M) CID-2V (5.8 l) laboratory engine configured as described in Example I accumulated about 1748 hours of operation at substantially the operating conditions described in Example I and substantially employing a seven minute cycle consisting of an idle mode and 35 and 65 mph (57 and 105 km/h) cruise modes with attendant accelerations and decelerations. After fuel consumption was measured at several speeds all intake port deposits were removed and fuel consumption was again determined. After a few hours of operation to ensure stable operation, the heads were again removed and the intake ports coated with a curable silicone polymer (G.E. RTV Silicone Sealer) hand applied to an apparent average thickness of about 60 mils. After the silicone had cured at room temperature, the engine was reassembled and fuel consumption determined. The results of this test are shown in Table II.

TABLE II

EFFECT OF INTAKE PORT DEPOSITS ON FUEL CONSUMPTION
1977 Ford 351 (M) CID-2V Engine

| Engine | Fuel Consumption | | | | | | | | | |
|---|---|---|---|---|---|---|---|---|---|---|
| | 65 mph | | 55 mph | | 45 mph[a] | | 35 mph | | 30 mph | |
| Hours | g/min | % incr | g/min | % incr | g/min | % incr | g/min | % incr | g/min | % incr |
| 1748 | 177.6 | — | 126.3 | — | 92.7 | — | 66.5 | — | 57.6 | — |
| Removed all intake port deposits | | | | | | | | | | |
| 1752 | 173.0 | −2.6 | 123.4 | −2.4 | 94.7 | 2.0 | 68.8 | 2.3 | 61.3 | 3.7 |
| Coated intake ports with thin layer of G.E. RTV Silicone Sealer | | | | | | | | | | |
| 1754 | 176.3 | 1.9 | 125.6 | 1.8 | 95. | 0.4 | 68.1 | −1.0 | 60.0 | −2.2 |

[a]EGR valve operation erratic at this speed.

The data in Table II show reduced fuel consumption at lower speeds compared to the same engine free of the naturally accumulated deposits, but somewhat higher consumption at speeds of 45 mph and above. The exhaust gas recirculation valve operated erratically at 45 mph and its' effect at this speed is uncertain.

What is claimed is:

1. In a spark ignition reciprocating internal combustion engine for use with gasoline fuels said engine having an intake port area extending between an intake manifold and an intake valve, said valve disrupting flow of a fuel air mixture into a combustion chamber; the improvement which comprises having a substantial portion of the surface of said intake port area coated with a thermal insulating material for reducing transfer of heat to the fuel/air mixture which traverses said intake port area during operation of said engine, said insulating material consisting essentially of one of the group of polyphenylene sulfide alone and polyphenylene sulfide in combination with synthetic resinous polymeric materials having in their chemical structure at least one element selected from fluorine and silicon.

2. A spark ignition engine as in claim 1 wherein the engine has a plurality of combustion chambers and a plurality of thermally insulated intake port areas.

3. A spark ignition engine as in claim 1 wherein the insulating material has a thermal conductance of from about 30 B.T.U./hr/sq.ft/°F. to about 5000 B.T.U./hr/sq.ft/°F.

4. A spark ignition engine as in claim 1 wherein the insulating material has a thermal conductance of from about 50 BTU hr/sq.ft/°F. to about 1000 BTU/hr/sq.ft/°F.

5. A spark ignition engine as in claim 1 wherein the insulating material which contains fluorine in its chemical structure is selected from polytetrafluoroethylene and fluorinated ethylene propylene copolymer.

6. A spark ignition engine as in claim 1 wherein the insulating material which contains silicon in its chemical structure is selected from silicone homopolymers and copolymers and polysiloxane resins.

7. A method for reducing the fuel consumption of gasoline fueled spark ignition engine having an intake port area extending between an intake manifold and an intake valve comprising coating a substantial portion of the surfaces of said intake port area with a thermally insulating material consisting essentially of one of the group of polyphenylene sulfide alone and polyphenylene sulfide in combination with synthetic resinous polymeric materials having in their chemical structure at least one element selected from fluorine, and silicon.

8. A method as in claim 7 wherein said insulating material has a thermal conductance from about 30 BTU/hr/sq.ft/°F. to about 5000 BTU/hr/sq.ft/°F.

* * * * *